US006568675B1

(12) United States Patent
Boss

(10) Patent No.: US 6,568,675 B1
(45) Date of Patent: May 27, 2003

(54) SHEET MEDIA OUTPUT DEVICE

(75) Inventor: Roland Boss, Guadalajara (MX)

(73) Assignee: Hewlett-Packard Development Co., L.P., Houston, TX (US)

( * ) Notice: Subject to any disclaimer, the term of this patent is extended or adjusted under 35 U.S.C. 154(b) by 158 days.

(21) Appl. No.: 09/724,440

(22) Filed: Nov. 28, 2000

(51) Int. Cl.[7] ..... B65H 39/10
(52) U.S. Cl. ..... 271/292; 271/294
(58) Field of Search ..... 271/292, 294, 271/287, 288, 297, 298, 305; 270/52.02, 52.03

(56) References Cited

U.S. PATENT DOCUMENTS 4,437,660 A * 3/1984 Tompkins et al. ..... 271/290
4,470,356 A * 9/1984 Davis et al. ..... 271/292 X
4,555,106 A * 11/1985 Ruenzi ..... 271/297
5,172,908 A * 12/1992 Steinhilber ..... 271/288
5,180,158 A 1/1993 Coombs
5,435,544 A * 7/1995 Mandel ..... 271/298
5,632,479 A * 5/1997 Kubota et al. ..... 271/296
5,934,669 A * 8/1999 Uchida et al. ..... 271/288
5,960,230 A 9/1999 Peter ..... 399/23
6,246,926 B1 * 6/2001 Ishii et al. ..... 271/288 X

FOREIGN PATENT DOCUMENTS

EP 0931745 A2 7/1999
EP 0942334 A1 9/1999
EP 0948187 A2 10/1999

* cited by examiner

*Primary Examiner*—David H. Bollinger

(57) ABSTRACT

A multiple bin output device for use with an image forming device. The output device comprises a plurality of removable bins configured to receive sheets output by the image forming device. The output device can either move a selected bin into position to receive a sheet or the device can guide a sheet into a selected removable but otherwise stationary bin.

5 Claims, 10 Drawing Sheets

SHEET MEDIA OUTPUT DEVICE

FIELD OF THE INVENTION

The invention relates to an output device for printers, copiers and other image forming devices that output sheet media. More particularly, the invention relates to an output device capable of selectively guiding media sheets into a plurality of removable bins.

BACKGROUND

Conventional multiple bin sheet media output devices typically use a series of vertically stacked bins or trays positioned at the side of a printer, copier, or other image forming device. Some output devices utilize a reversible motor that turns a spiral cam or other suitable transmission device to drive the bins up and down to align the proper bin with the printer output. Other output devices use sliding paper diverters that direct each sheet to the proper bin or, for some of the larger devices, a paper transport system that conveys each sheet to the proper bin. In any case, the bins are not removable from the output device. It would be advantageous for some printing and finishing operations, particularly high speed large volume operations, to incorporate removable output bins into the sheet media output device.

SUMMARY

Accordingly, the present invention is directed to a multiple bin output device for use with an image forming device. The output device comprises a plurality of removable bins configured to receive sheets output by the image forming device. The output device can move a selected bin into position to receive a sheet or the device can guide a sheet into a selected removable but otherwise stationary bin.

DETAILED DESCRIPTION

Figure 2:
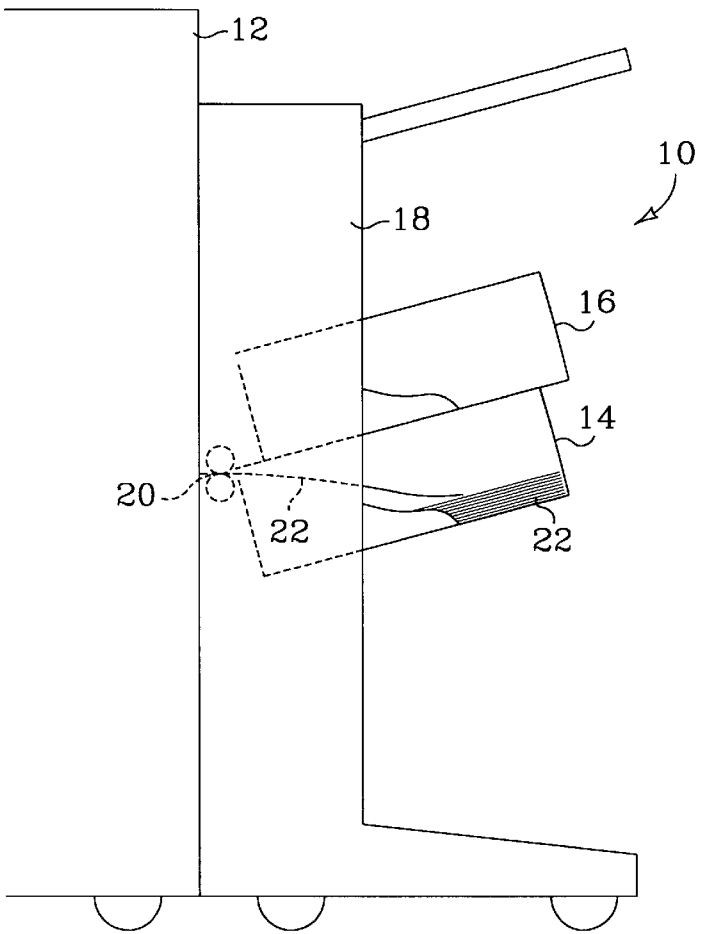
FIGS. 1–6 are elevation side views of one embodiment of the invented removable bin output device in which the bins move down, showing in sequence outputting paper to a first bin followed by outputting paper to a second bin while the first bin is removed, emptied and then reinstalled into the output device to receive more paper.
Figure 1:
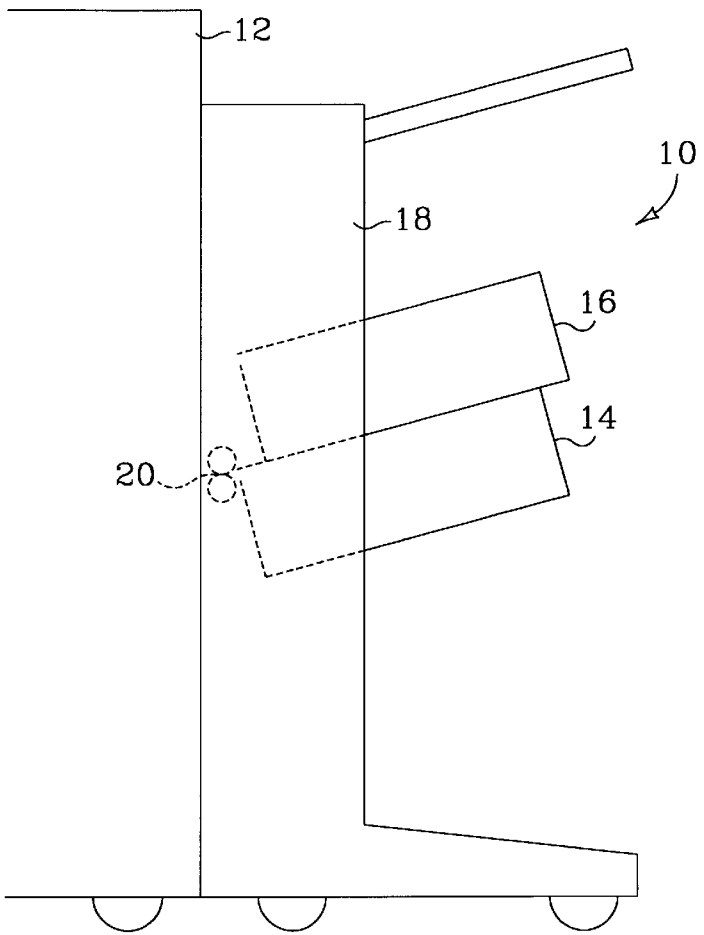
Figure 4:
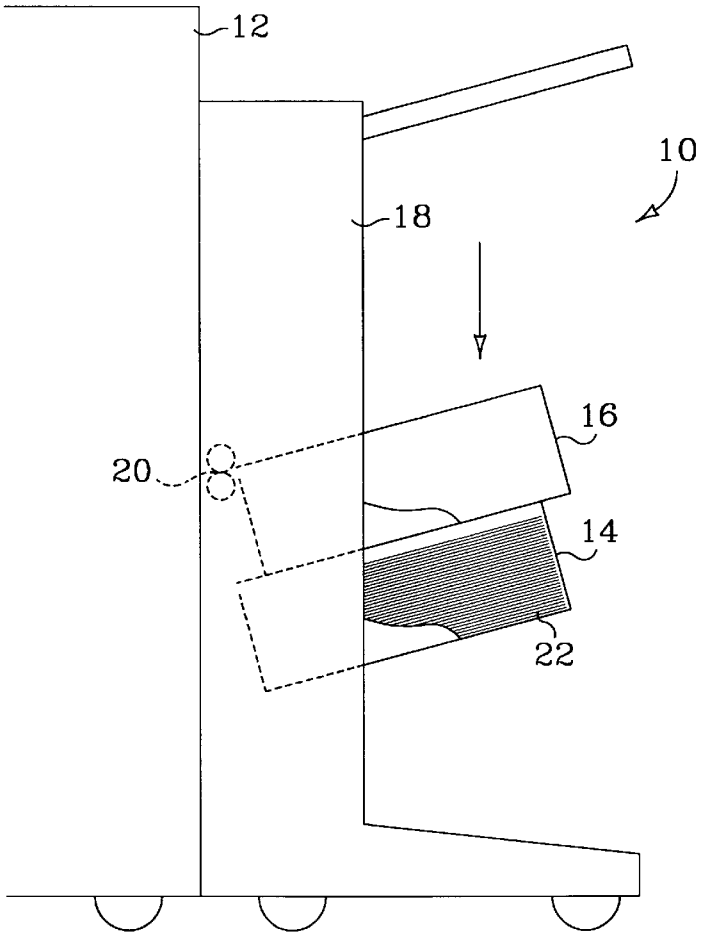
Figure 3:
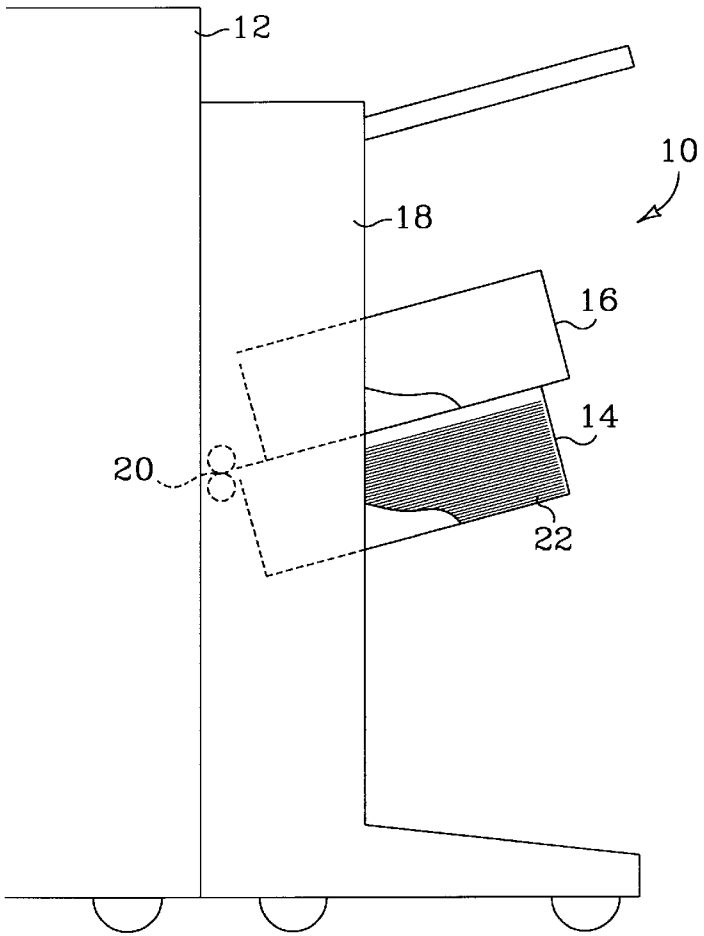

The invented output device is designed for use with or as an integrated part of any printer, copier or other image forming device in which it may be desirable to utilize the capabilities of a multiple bin sorter, stacker, or similar output device. The following description and the drawings illustrate only a few exemplary embodiments of the invention. Other embodiments, forms and details may be made without departing from the spirit and scope of the invention, which is expressed in the claims that follow this description.

FIGS. 1–6 and 14–19 show a multiple bin output device 10 attached to printer 12. In the embodiments of FIGS. 1–6 and 14–19, output device 10 is a stand alone unit that is operatively coupled to printer 12. Output device 10 might also be integrated into printer 12 such that some of the operational components of output device 10 are built into printer 12. Output device 10 includes removable sheet media bins 14 and 16 partially enclosed by housing 18. Printer 12 outputs each sheet to sheet input drive 20 of output device 10.

Figure 6:
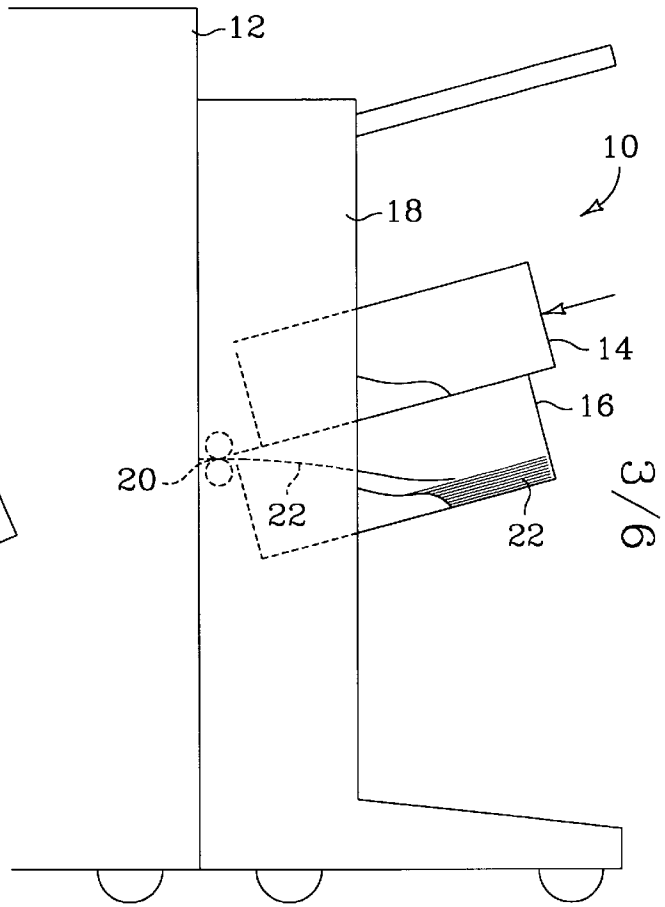
Figure 5:
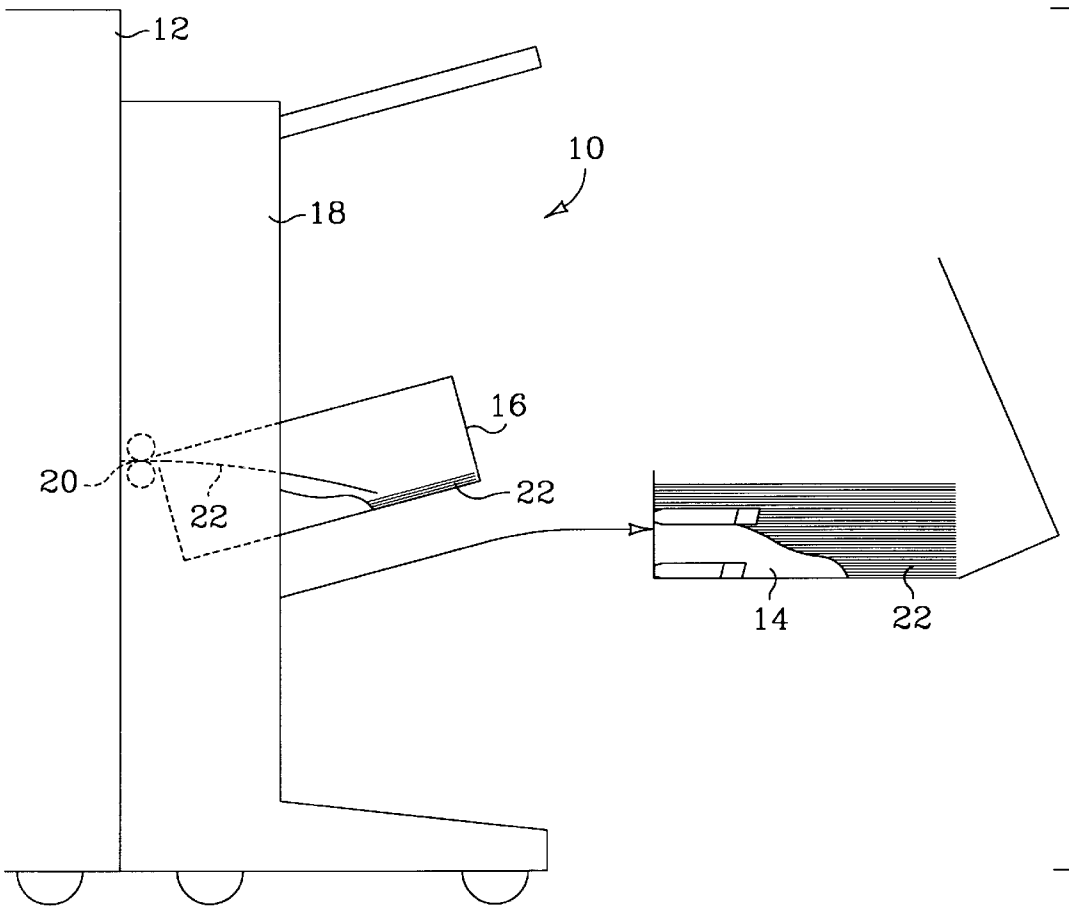
Figure 7:
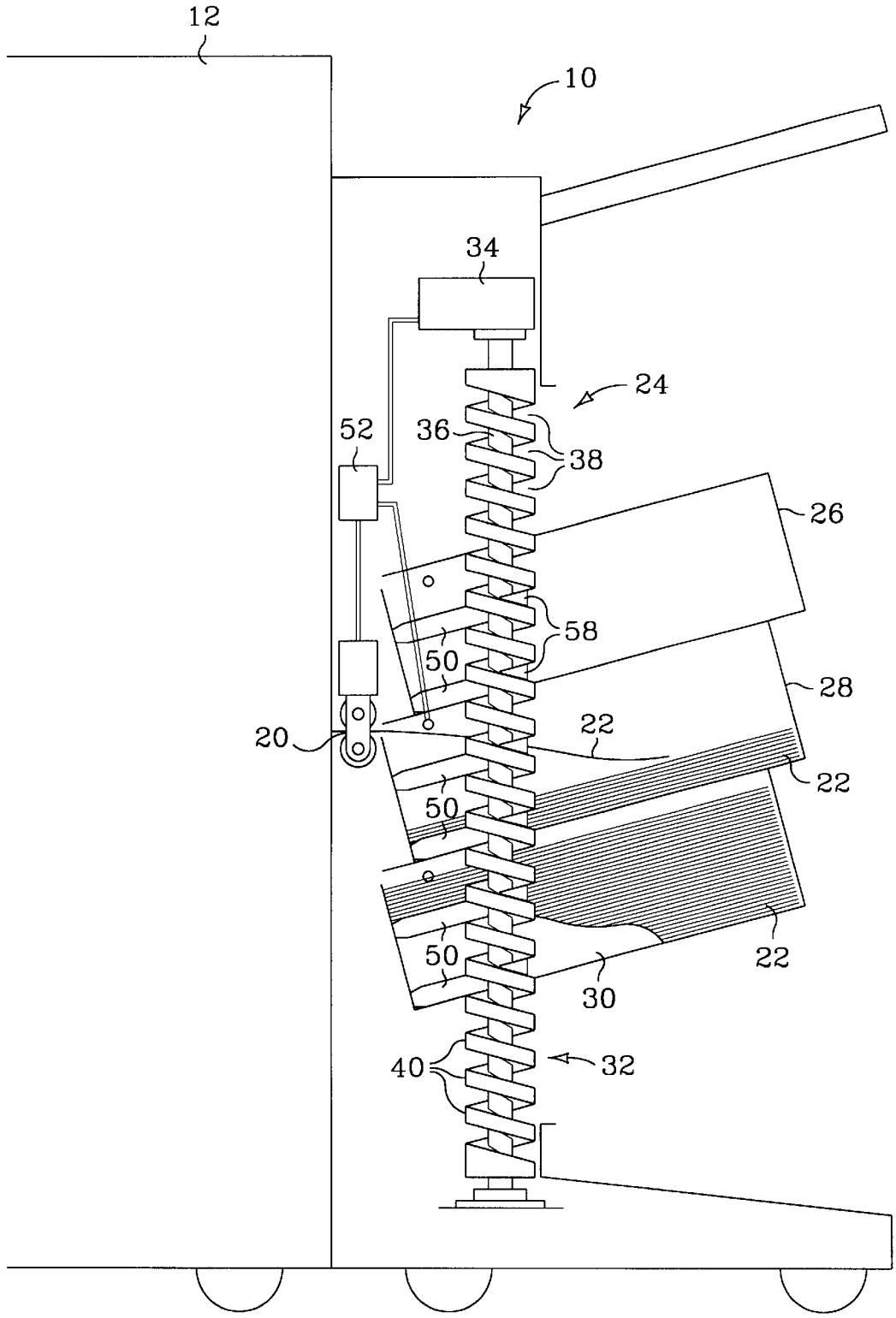
FIG. 7 is an elevation side view of a spiral shaft type transport mechanism used to move the bins into the paper receiving position according to one embodiment of the present invention.
Figure 19:
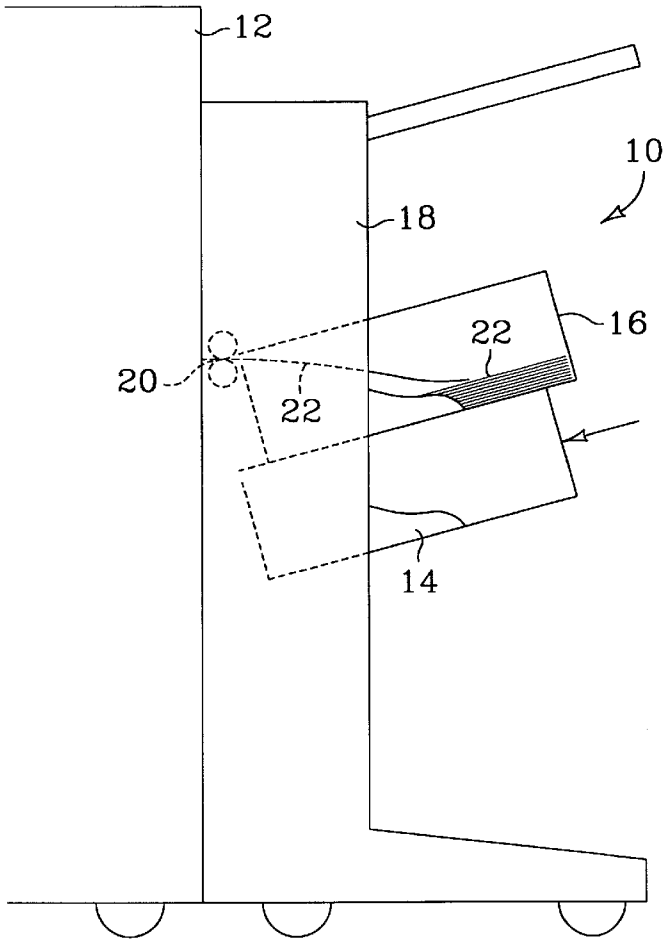
Figure 18:
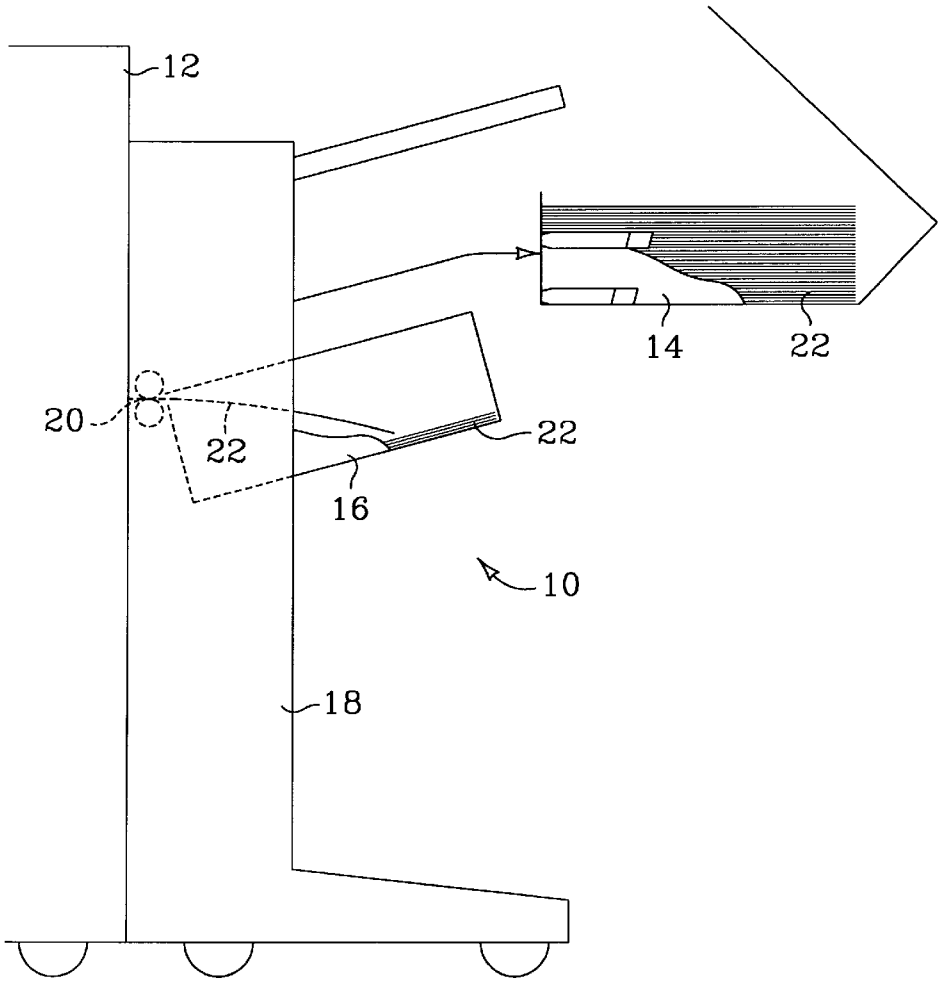

FIGS. 1–6 show the sequence of operation of output device 10 with bins that move down through the sheet receiving position. FIGS. 14–19 show the sequence of operation of output device 10 with bins that move up through the sheet receiving position. In FIGS. 1–2 and 14–15, first bin 14 is aligned to sheet input drive 20. Initially, sheets output by printer 12 are directed through input drive 20 into first bin 14 as shown in FIG. 2. Referring to FIGS. 3–4 and 16–17, when first bin 14 is full (FIGS. 3 and 16), or the pages designated for output to first bin 14 are completed, first and second bins 14 and 16 move down (FIG. 4) or up (FIG. 17) until second bin 16 is aligned with input drive 20. Sheets 22 output by printer 12 are then directed into second bin 16 as shown in FIGS. 5–6 and 18–19. FIGS. 5–6 and 18–19 also illustrate the removal (FIGS. 5 and 18) and reinstallation (FIGS. 6 and 19) of first bin 14. First bin 14 can then be taken to any post-printing processing station while printing into second bin 16 continues. Once first bin 14 has been emptied, it can be reinstalled on top of second bin 16 as shown in FIG. 6 or below second bin 16 as shown in FIG. 19.

One embodiment of output device 10 incorporates a bin transport mechanism 24 shown in FIGS. 7–10. To align a selected bin 26, 28, 30 with input drive 20, transport mechanism 24 includes spiral shafts 32, 42 (spiral shaft 42) is only visible in FIG. 8) located on each side of bins 26, 28, 30. Spiral shafts 32 and 42 are driven by a stepper motor 34. Spiral shaft 32, visible in FIG. 7, includes a rod 36 with a continuous diagonal slot 38 created by continuous surface 40 spiraling counter-clockwise down rod 36. The second spiral shaft 42, visible in FIG. 8, includes rod 44 with continuous diagonal slot 46 formed by a continuous surface 48 spiraling clockwise down rod 44. One or more runners 50 are placed on each side of each bin 26, 28, 30. As one bin 26, 28, or 30 is inserted between spiral shafts 32, 42 at an angle defined by slots 38, 46, runners 50 slide into slots 38, 46 temporarily securing that bin in place.

Stepper motor 34, under the instruction of controller 52, rotates spiral shafts 32, 34 in opposing directions around axes A and B causing bins 26, 28, 30 to move vertically either up or down as desired. For example, rotating spiral shaft 32 counter clockwise while rotating spiral shaft 42 clockwise causes bins 26, 28, 30 to move upward. Reversing the rotation of each spiral shaft 32, 42 causes bins 26, 28, 30 to move downward. Although other types of motors may be used, a stepper motor is desirable because it can function both as a source of motive power and as an indexing mechanism allowing controller 52 to precisely align a selected bin 26, 28, or 30 with input drive 20.

Figure 9:
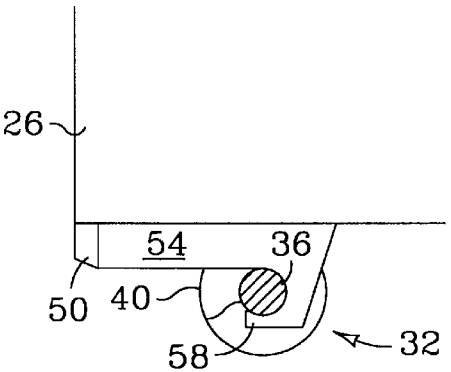
FIGS. 8–10 are front, side and plan detail views of a spiral shaft type transport mechanism similar to that shown in FIG. 7.
Figure 10:
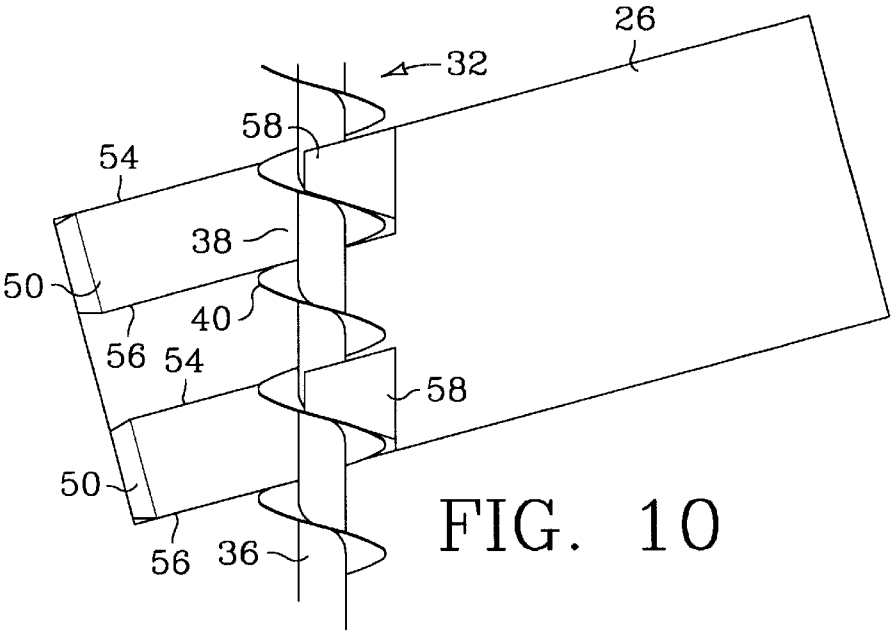
Figure 8:
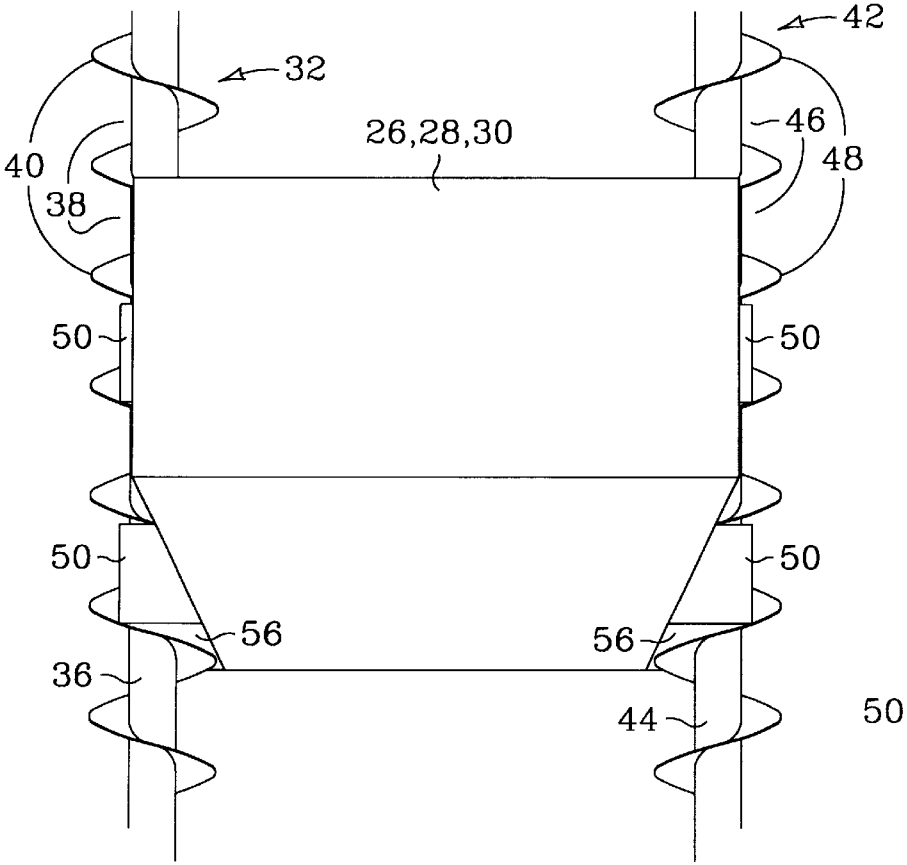

FIGS. 8–10 provide a more detailed illustration of one embodiment of spiral shafts 32, 42 and runners 50. Each runner 50 includes an upper surface 54 and an opposing lower surface 56 that define a width slightly less than that of slots 38, 46. Each runner 50 also includes grips 58 shaped to fit partially around one rod 36 or 44 within slot 38 or 46 of spiral shaft 32 or 34. As each bin is inserted into output device 10 upper and lower surfaces 54, 56 of each runner 50 slide into slots 38, 46 until grips 58 capture rods 36, 44. Once fully inserted, bins 26, 28, 30 are held at an angle defined by slots 38, 46.

Figure 11:
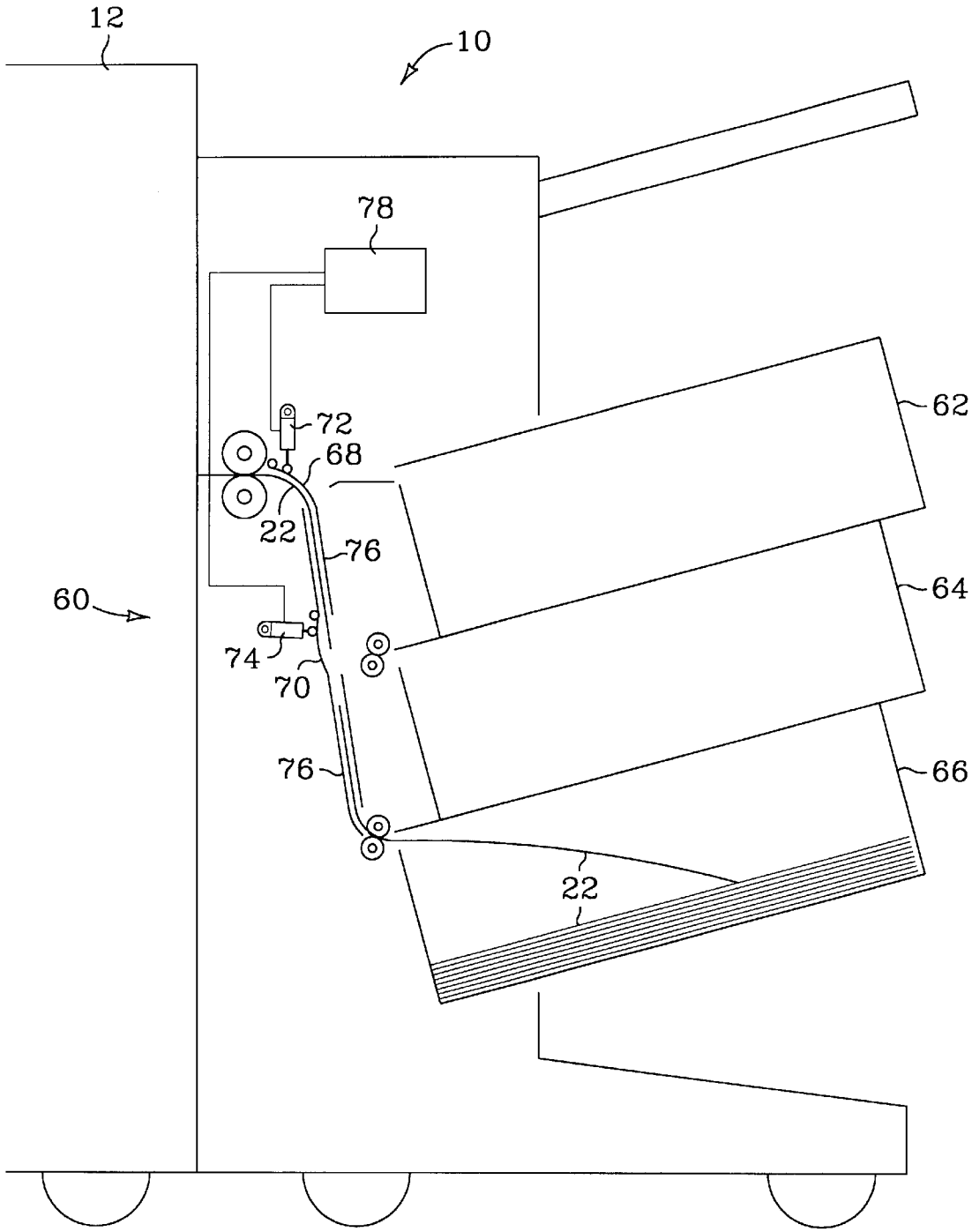
FIGS. 11–13 are elevation side views of a diversion system used to guide the media sheets into a selected bin according to one embodiment of the present invention showing in sequence diverting paper to the lower bin, the middle bin and then the top bin.
Figure 13:
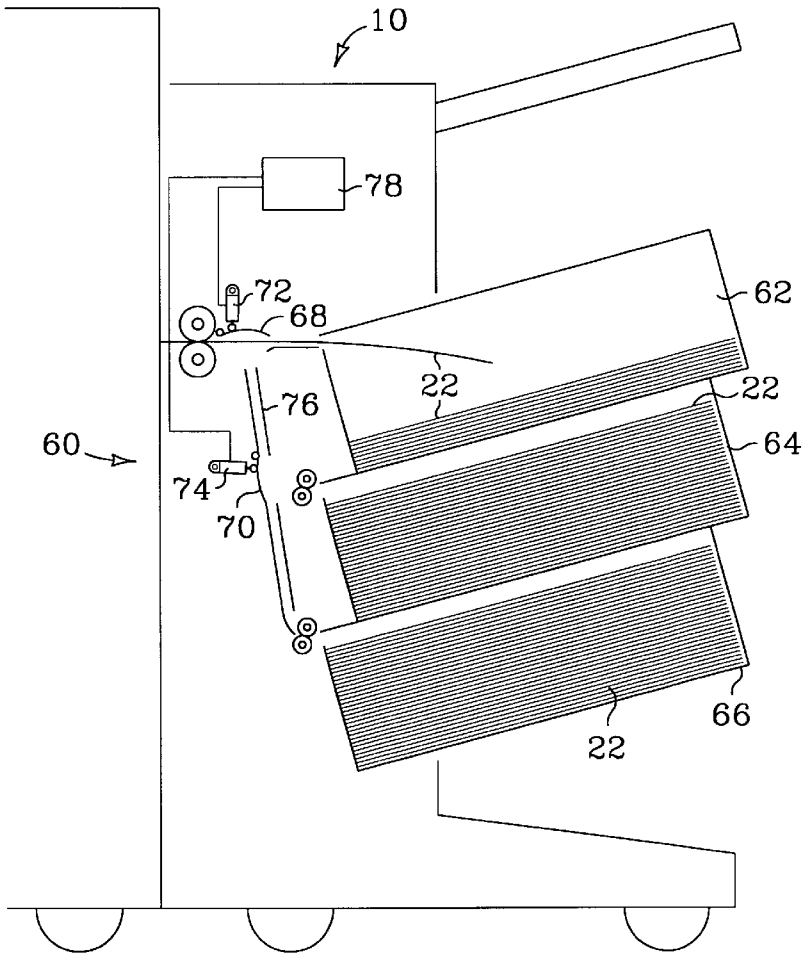
Figure 12:
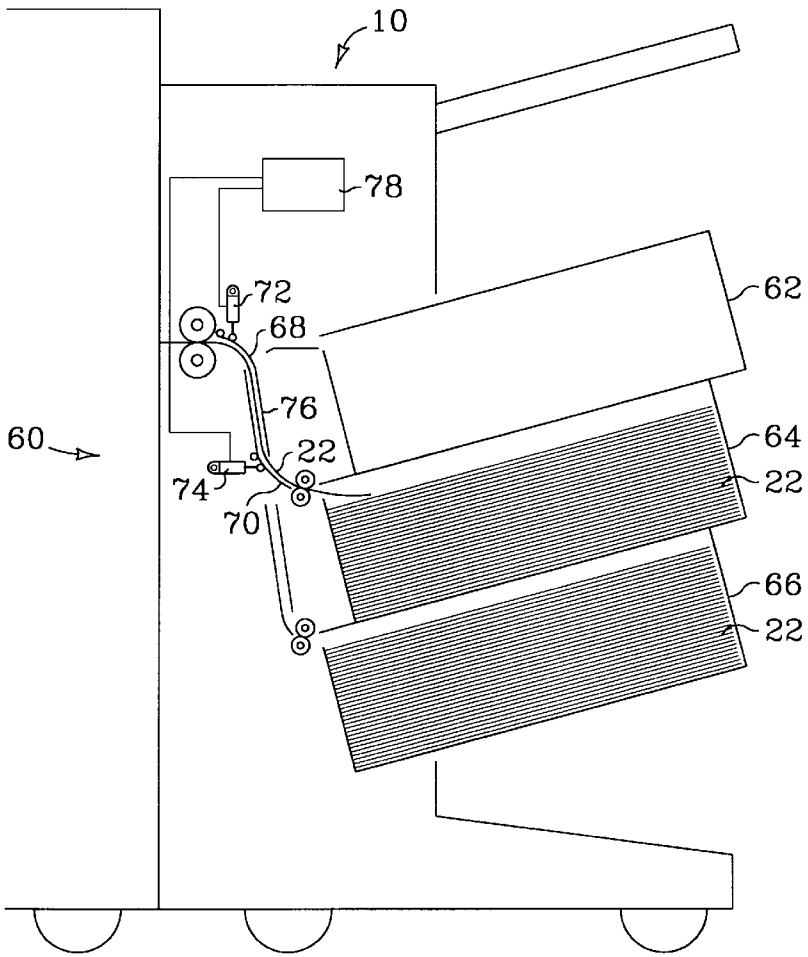
Figure 15:
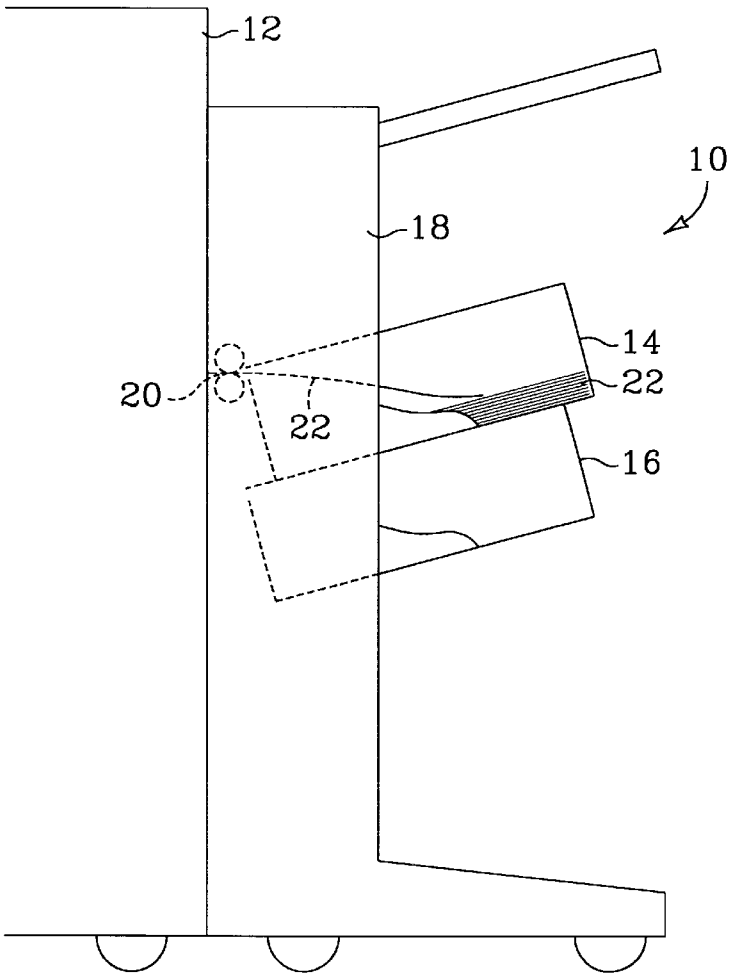
FIGS. 14–19 are elevation side views of one embodiment of the invented removable bin output device in which the bins move up, showing in sequence outputting paper to a first bin followed by outputting paper to a second bin while the first bin is removed, emptied and then reinstalled into the output device to receive more paper.
Figure 14:
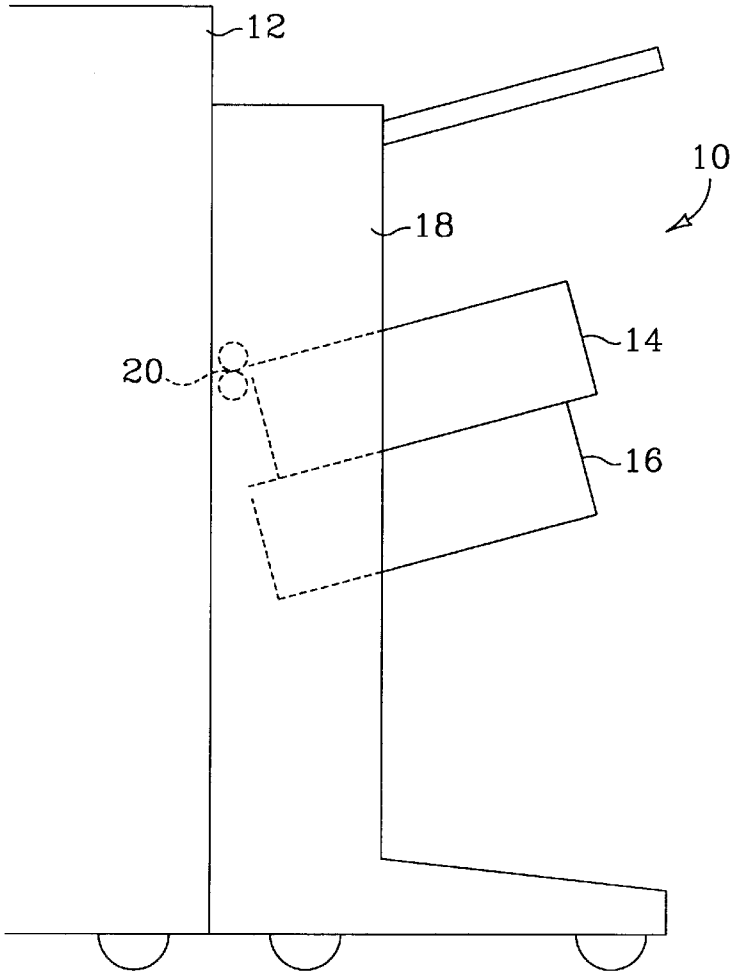
Figure 17:
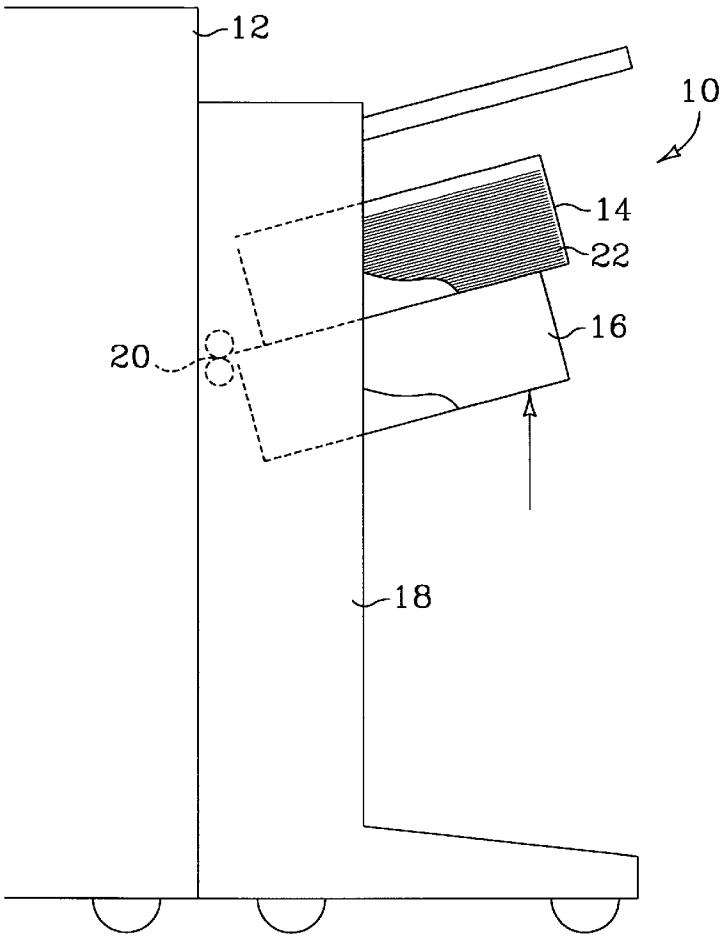
Figure 16:
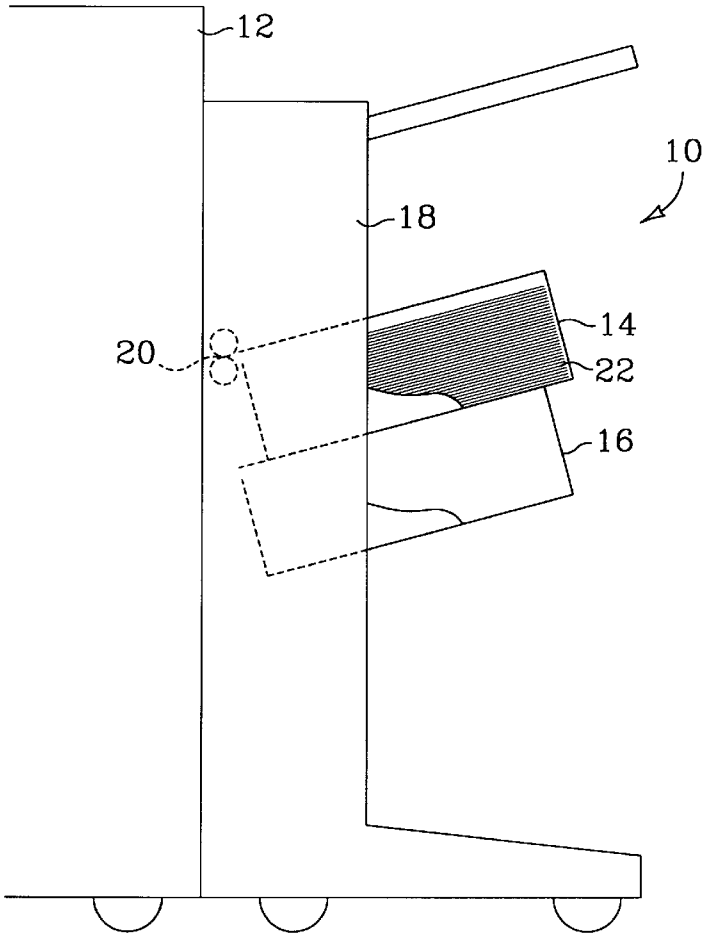

Referring now to FIGS. 11–13, instead of moving the bins into position to receive sheets 22 using the transport mechanism shown in FIGS. 7–10, output device 10 may include diversion system 60 to route sheets 22 into the selected removable but otherwise stationary bins 62, 64, 66. Diversion system 60 includes diverters 68 and 70 connected to actuators 72 and 74 spaced along sheet path 76 at locations corresponding to each of bins 62, 64, 66. Input drive 20 receives and feeds sheets 22 into sheet path 76. Controller 78 sends a signal to the appropriate actuator 72 or 74 moving the corresponding diverter 70 or 72 into or out of sheet path 76. As feed rollers 80 move sheet 22 along path 76, the activated diverter 70 or 72 guides sheet 22 into a selected bin 62, 64, or 66.

In FIG. 11, controller 78 has instructed actuator 72 to move diverters 68 and 70 into path 76 to divert each sheet 22 in to bottom bin 66. In FIG. 12, controller 78 has instructed actuators 72 and 74 to move diverter 68 into path 76 and diverter 70 out of path 76 to divert each sheet 22 in to middle bin 64. In FIG. 13, top diverter 68 is moved out of path 76 to allow each sheet 22 to pass directly into top bin 62.

It is envisioned that each bin will include a unique and recognizable identification tag. Printer 12 can then send sheet 22 to output device 10 with instructions to place sheet 22 into a bin with a specified identification tag. In response, controller 52 detects the position of the specified bin and instructs transport mechanism 24 to move that bin into position to receive sheet 22. Or, if diversion system 60 is in use, controller 78 detects the position of the specified bin and instructs the appropriate actuator 74 or 76 to slide the corresponding diverter 70 or 72 into or out of path 76 guiding sheet 22 into that bin.

Identification tags may be bar codes or color strips placed on the exterior of each bin. As each bin is secured within the output device 10, the identification tag aligns with an optical scanner which is directed by controller 52 (FIG. 7) or controller 78 (FIG. 11). Alternatively, identification tags may be electronic codes stored on integrated circuits or removable media contained on or in each bin, or they may be electro-mechanical switches such that installing a bin into device 10 generates a signal or pattern unique to that bin. As each bin is inserted into output device 10 the identification tag is electronically coupled to controller 52 (FIG. 7) or controller 78 (FIG. 11). The controller 52 or 78 then recognizes the presence, location, and identity of the bin and automatically prints any jobs queued for that bin. Electronic identification tags may be used to store a variety of information locally on the bins. The tags, for example, could store document finishing instructions for finishing operations at a location remote from the printer. In such cases, the document is printed and output to the designated bin and finishing instructions are simultaneously communicated to the bins electronic tag. When the bin is later moved to and installed in a finishing device, the finishing instructions are automatically communicated from the bin tag to the finishing device.

It is also envisioned that output device 10 may also detect when a bin is filled to capacity and either instruct printer 12 to pause printing or cause sheets 22 to be placed in another bin. Output device 10 may include an optical sensor in each bin. Inserting bins into output device 10 electronically couples the optical sensors with controller 52 (FIG. 7) or controller 78 (FIG. 11). When one of the sensors detects that sheets 22 have reached a certain height within a bin, controller 52 or 78 causes sheets 22 to be placed in an empty bin or instructs printer 12 to pause printing. The senors may instead be mechanical devices detecting the weight or height of sheets 22 within the bins.

Alternatively, U.S. Pat. No. 5,960,230, incorporated herein by reference, issued to Gary M. Peter in 1999 discloses a method and device for sensing the number of media sheets in a tray or bin. The techniques and devices disclosed in that patent could be used to allow output device 10 to sense when a bin is reaching its capacity.

Advantageously, once one bin is full and while printing continues with sheets being deposited into an empty bin, the full bin can be removed from output device 10 and taken to a post printing finishing station where the bin could serve as an input bin or tray. In this way printing can continue without interruption so long as one bin having the capacity to receive more sheets is present in device 10.

Printer 12 may also contain a memory, often referred to as a print queue, for holding print requests for later retrieval. It is envisioned that printer 12 will be electronically connected to one or more computers either directly through a parallel or serial connection or remotely over a computer network. Applications running on those computers periodically send requests to printer 12 to produce one or more desired documents and to direct those documents to a specified bin 14, 16. Should controller 52 (FIG. 7) or 78 (FIG. 11) detect that the specified bin 14 or 16 is full or not present in device 10, printer 12 stores the print request in the print queue until the specified bin is emptied or installed. This is commonly referred to as queuing a print request. Alternatively, the print queue may be located within device 10 or any other electronic device coupled to printer 12.

What is claimed is:

1. A multiple bin output device for use with an image forming device, the output device comprising:

a plurality of removable movable bins configured to receive sheets output by the image forming device, each bin including an identification tag uniquely identifying that bin;

a transport mechanism operatively coupled to the bins, the transport mechanism operative when the device is installed for use with the image forming device to move each of the bins into a sheet receiving position; and a controller in operative communication with the transport mechanism and the bins, the controller operative to detect the presence of a bin having a specified identification tag and to cause the motor to move the bin having the specified identification tag into the sheet receiving position.

2. The output device of claim 1, wherein the controller is also in operative communication with the image forming device, the controller being further operative to direct the image forming device to queue any print request that includes directions to direct sheets into a bin having a specified identification tag until the controller detects the presence of the bin with the specified identification tag.

3. A multiple bin output device for use with an image forming device, the output device comprising:

a plurality of removable movable bins configured to receive sheets output by the image forming device, each bin including an identification tag uniquely identifying that bin;

a transport mechanism operatively coupled to the bins, the transport mechanism operative when the device is installed for use with the image forming device to move each of the bins into a sheet receiving position;

a controller in operative communication with the transport mechanism and the bins, the controller operative to cause the motor to move the bin having the specified identification tag into the sheet receiving position and to detect when a bin with a specified identification tag has been filled to its capacity; and the controller is also in operative communication with the image forming device, the controller being further operative to direct the image forming device to queue any print request that includes directions to direct sheets into a bin having a specified identification tag until the controller detects the bin with the specified identification tag is not filled to its capacity.

4. A multiple bin output device for use with an image forming device, the device comprising:

a plurality of removable but otherwise stationary bins configured to receive sheets output by the image forming device, each bin including an identification tag uniquely identifying that bin;

a sheet diversion system configured to receive a sheet from the image forming device and guide the sheet to one of the bins;

a controller in operative communication with the diversion system and the bins, the controller operative to detect the presence of a bin having a specified identification tag and to cause the diversion system to guide a sheet output by the image forming device into the bin having the specified identification tag; and wherein the controller is also in operative communication with the image forming device, the controller being further operative to direct the image forming device to queue any print request that includes directions to direct sheets into a bin having a specified identification tag until the controller detects the presence of the bin with the specified identification tag.

5. A multiple bin output device for use with an image forming device, the device comprising:

a plurality of removable but otherwise stationary bins configured to receive sheets output by the image forming device, each bin including an identification tag uniquely identifying that bin;

a sheet diversion system configured to receive a sheet from the image forming device and guide the sheet to one of the bins; and a controller in operative communication with the diversion system and the bins, the controller operative to cause the diversion system to guide a sheet output by the image forming device into the bin having the specified identification tag and to detect when a bin with a specified identification tag has been filled to its capacity; and the controller is also in operative communication with the image forming device, the controller being further operative to direct the image forming device to queue any print request that includes directions to direct sheets into a bin having a specified identification tag until the controller detects the bin with the specified identification tag is not filled to its capacity.

* * * * *

UNITED STATES PATENT AND TRADEMARK OFFICE

CERTIFICATE OF CORRECTION

PATENT NO. : 6,568,675 B1
DATED : May 27, 2003
INVENTOR(S) : Roland Boss

It is certified that error appears in the above-identified patent and that said Letters Patent is hereby corrected as shown below:

Column 4,
Line 54, delete “a motor” and insert therefor -- the motor --
Line 61, delete “a bin having a” and insert therefor -- the bin having the --

Column 5,
Line 9, delete “the motor” and insert therefor -- a motor --
Line 9, delete “the bin” and insert therefor -- a bin --
Line 9, delete “the specified” and insert therefor -- a specified --
Line 11, delete “a bin with a” and insert therefor -- the bin with the --
Line 18, delete “a bin having a” and insert therefor -- the bin having the --

Column 6,
Line 5, delete “a bin having a” and insert therefor -- the bin having the --
Line 23, delete “the bin having the” and insert therefor -- a bin having a --
Line 24, delete “a bin” and insert therefor -- the bin --
Line 25, delete “a specified” and insert therefor -- the specified --
Line 31, delete “the bin having the” and insert therefor -- a bin having a --

Signed and Sealed this

Second Day of August, 2005

JON W. DUDAS
*Director of the United States Patent and Trademark Office*